US007081862B2

(12) United States Patent
Tsai

(10) Patent No.: US 7,081,862 B2
(45) Date of Patent: Jul. 25, 2006

(54) INTEGRATED ACTIVE SATELLITE ANTENNA MODULE

(75) Inventor: Yueh-Lin Tsai, Shulin Siang (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 0 days.

(21) Appl. No.: 11/073,667

(22) Filed: Mar. 8, 2005

(65) Prior Publication Data

US 2006/0049992 A1 Mar. 9, 2006

(30) Foreign Application Priority Data

Sep. 7, 2004 (TW) ..... 93214243 U

(51) Int. Cl.
*H01Q 13/00* (2006.01)
*H01Q 3/24* (2006.01)
*H01Q 21/00* (2006.01)

(52) U.S. Cl. ..... 343/772; 343/876; 343/781 P; 343/893

(58) Field of Classification Search ..... 343/772, 343/781 P, 782, 876, 893
See application file for complete search history.

(56) References Cited

U.S. PATENT DOCUMENTS 6,952,573 B1 * 10/2005 Schucker et al. ..... 455/333
6,977,977 B1 * 12/2005 Dubrovin et al. ..... 375/346
2004/0198420 A1 * 10/2004 He et al. ..... 455/552.1
2005/0248402 A1 * 11/2005 Zhenbiao et al. ..... 330/129

* cited by examiner

*Primary Examiner*—Shih-Chao Chen
(74) *Attorney, Agent, or Firm*—Rosenberg, Klein & Lee

(57) ABSTRACT

An integrated active satellite antenna module has a low loss filter, a low noise amplifier, a switch, a chip, two input ends and an output end. A front-end microwave circuit is used for resolving the mutual coupling effect between the satellite antenna and the other antennas operating at any other frequencies in an integrated active satellite antenna module, and furthermore it provides the simultaneous operating condition for the individual antenna by improving the isolation level between the satellite frequency band and the other frequency band.

9 Claims, 4 Drawing Sheets

INTEGRATED ACTIVE SATELLITE ANTENNA MODULE

BACKGROUND OF THE INVENTION

1. Field of the Invention

The present invention relates to an integrated active satellite antenna module, and more particularly to resolve the mutual coupling effect between the weak satellite signal and the other frequency channels of the integrated active satellite antenna module by means of the design rule of the RF front end circuit 2. Description of Related Art Electromagnetic waves were extensively used to the radio communication in the $19^{th}$ century after the electromagnetic wave was discovered by Maxwell in 1864. An antenna is an interface for the radio transmission and reception. The transmitting antenna delivers an electromagnetic wave and the receiving antenna transforms the energy of the electromagnetic wave into a current to be processed by a receiving circuit. Hence, the antenna has to tune to the correct frequency to eliminate noise and amplify the weak signal.

The key of a receiving antenna design is to receive the electromagnetic signal efficiency and isolate the noise from any other sources around the antenna effectively. Hence, how to prevent the mutual coupling effect to influence the normal function of the individual antennas in an integrated multiple antenna unit is the most important task.

Reference is made to FIG. 1, which is a functional block diagram of an integrated active satellite antenna module of the prior art, including a first input end 1*a* for importing a passive antenna signal, a low noise amplifier 4*a* for amplifying the band signal, a low loss filter 3*a* for filtering a noise and a band signal of the passive antenna, and a second input end 2*a* for importing an active antenna signal. Moreover, a switch 5*a* receives the passive antenna signal filtered and the active antenna signal for switching the signal source. The antenna signal is demodulated via the chip 6*a* and the output end 7*a* for exporting the antenna signal demodulated.

To sum up, there are some following disadvantages of the prior art:

(1) There is a serious mutual coupling effect between the particular antennas embedded in a small place.

(2) A satellite signal can't be demodulated via the RF chipset due to the operating power of the other antennas is too high to be processed by the front end amplifier when the other antennas are working.

SUMMARY OF THE INVENTION

It is the first objective of the present invention to provide an integrated active satellite antenna module, which includes a RF front-end circuit for resolving the mutual coupling signal interference between the satellite antenna and the other antennas operating at any other frequencies in an integrated active satellite antenna module.

It is the second objective of the present invention to provide an integrated active satellite antenna module, which provides a RF front-end circuit for resolving the problem that the satellite signal can't be decoding via a RF chipset when any other antenna is working.

For achieving the objects stated above, an integrated active satellite antenna module comprises a first input end for importing a passive antenna signal thereof, a second input end for importing an active antenna signal thereof, a low loss filter for filtering a noise and a band signal of the passive antenna signal, a low noise amplifier for amplifying the band signal, a switch for choosing the passive or active antenna signal source from those two input end.

The first input end, the second input end, the low loss filter, the low noise amplifier, the switch, the chipset, and the output end are electrically connected There are two directions of the electric signal:

I. The passive antenna signal imports from the first input end, and processes the low loss filter, the low noise amplifier, the switch, the chip, and the output end in order; and II. The active antenna signal imports from the second input end, and processes the switch, the chip, and the output end in order.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
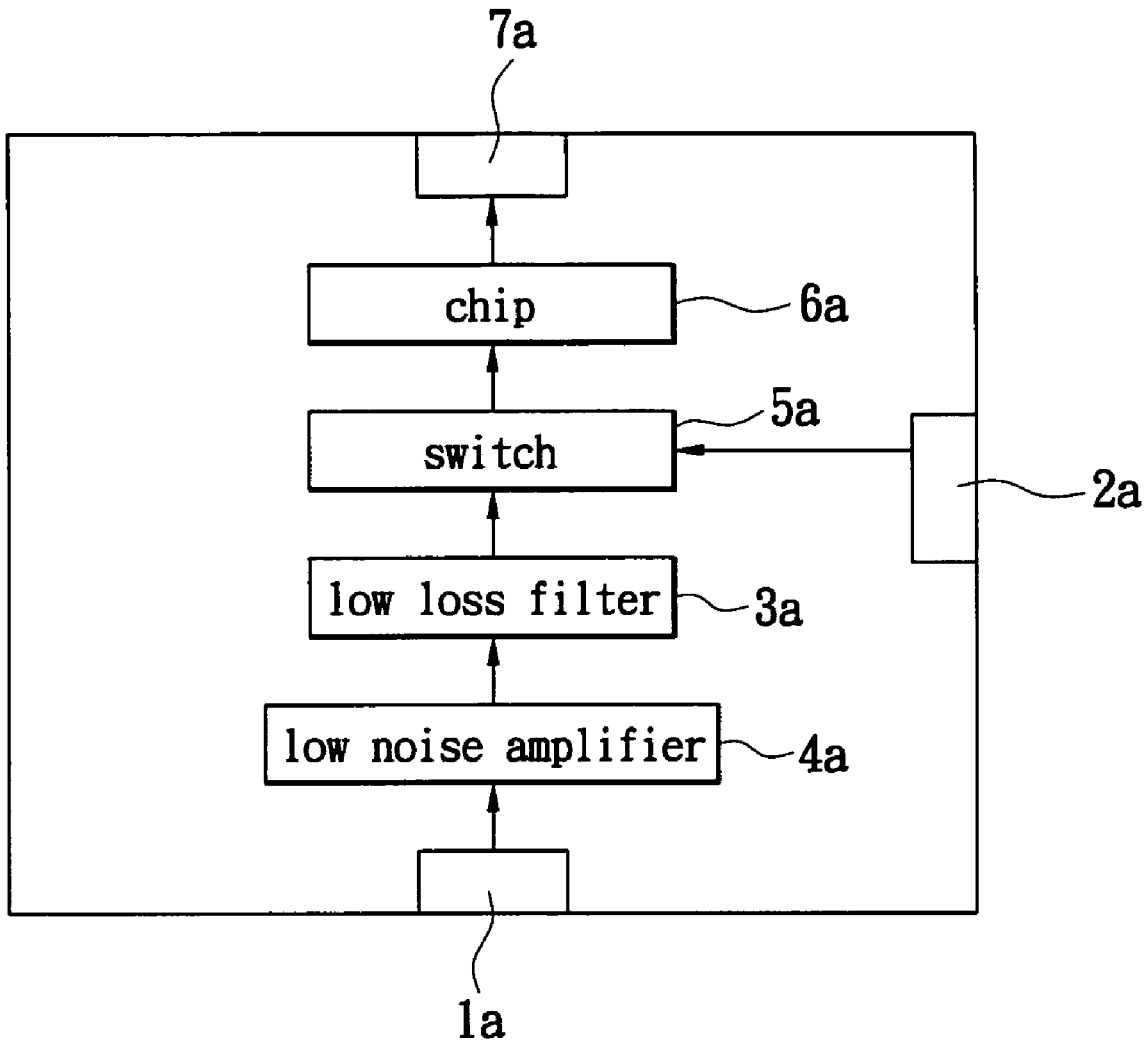
FIG. 1 PRIOR ART
FIG. 1 is a functional block diagram of an integrated active satellite antenna module of the prior art.
Figure 2:
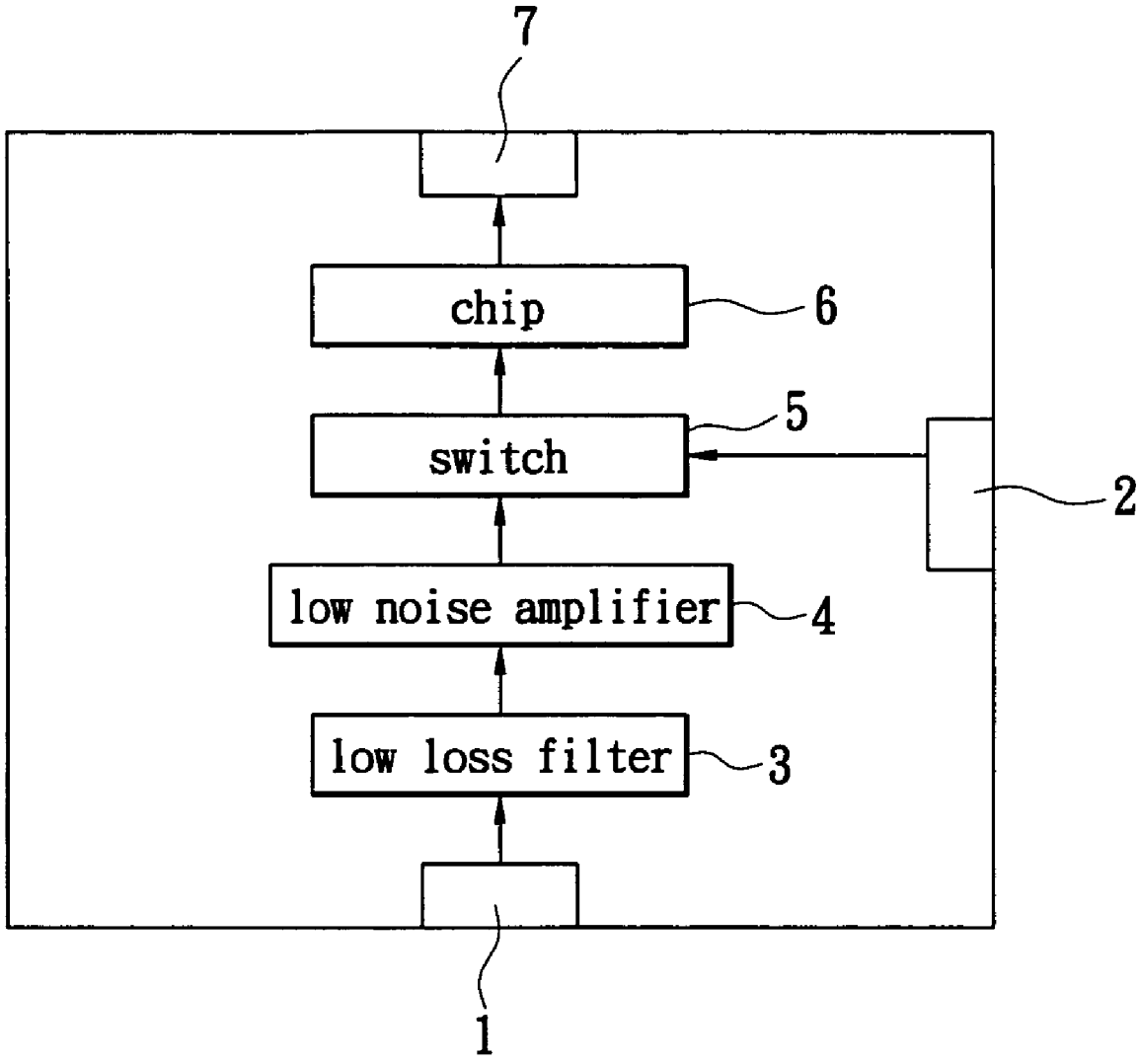
FIG. 2 is a functional block diagram of an integrated active satellite antenna module of the present invention.

Reference is made to FIG. 2, which is a functional block diagram of an integrated active satellite antenna module of the present invention. Included are a first input end 1, a second input end 2, a low loss filter 3, a low noise amplifier 4, a switch 5, a chip 6, and an output end 7. The first input end 1 is for importing a passive antenna signal thereof, and the second input end 2 is for importing an active antenna signal thereof, in which the active antenna signal is a global positioning system (GPS) antenna signal.

Furthermore, the low loss filter 3 is for filtering a noise and a band signal of the passive antenna signal, in which the low loss filter 3 is a band pass filter and the low loss filter 3 satisfies two conditions:

I. An insertion loss is less than 2.0 dB; and

II. An out-band rejection at 1710 MHz is greater than or equal to 25 dB.

Moreover, the low noise amplifier 4 for amplifying the band signal and the low noise amplifier 4 satisfy two conditions:

I. A noise figure is less than 1.5 dB; and

II. 1 dB gain compression point is greater than −25 dBm.

The switch 5 receives the band signal amplified via the low noise amplifier 4 and receives the active antenna signal imported from the second input end 2 for choosing the antenna signal source. The chip 6 is for demodulating the antenna signal deliver from the switch 5, and the chip 6 has an RF-processing function, the chip 6 has a baseband-demodulated function or the chip 6 has an RF-processing function and also a baseband-demodulated function, and the output end 7 is for exporting the antenna signal demodulated.

The first input end 1, the second input end 2, the low loss filter 3, the low noise amplifier 4, the switch 5, the chip 6, and the output end 7 are electrically connected in order. There are two directions of the electric signal:

I. The passive antenna signal imports from the first input end 1, and processes the low loss filter 3, the low noise amplifier 4, the switch 5, the chip 6, and the output end 7 in order; and II. The active antenna signal imports the second input end 2, and processes the switch 5, the chip 6, and the output end 7 in order.

Figure 3:
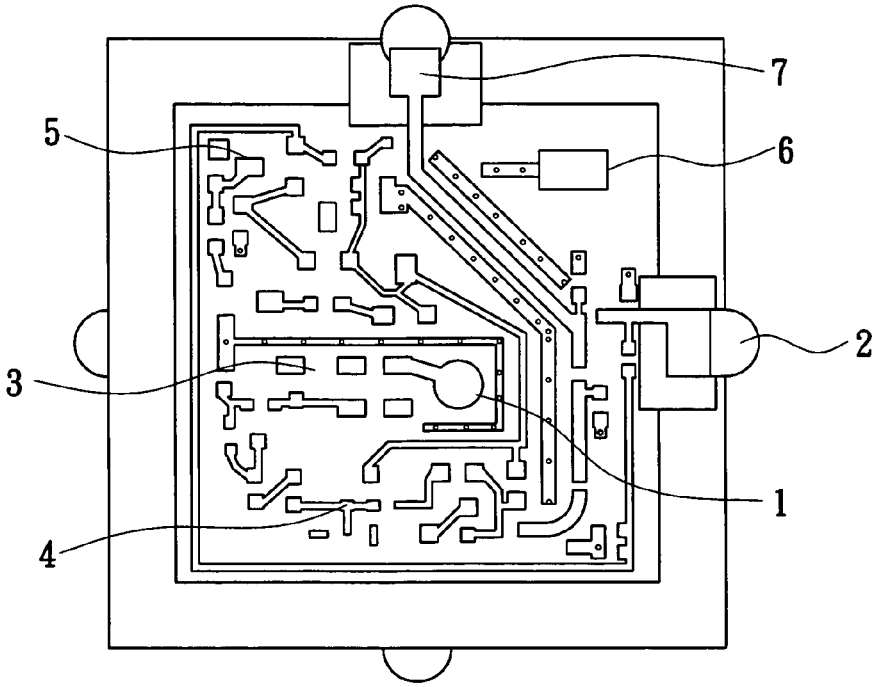
FIG. 3 is a physical layout for applying to the dual-antenna GPS/GSM unit of the present invention.

Reference is made to FIG. 3, which is a physical layout for application to the dual-antenna GPS/GSM unit of the present invention. A satellite signal is received from a ceramic antenna into the low loss filter 3 via the first input end 1. The low loss filter 3 provides an isolation of 30 dB between 1710 MHz and 1575.42 MHz. The satellite signal is amplified via the low noise amplifier 4 into the switch 5, and the chip 6 demodulates the satellite signal from the switch 5. Finally, the satellite signal output via the output end 7.

When a cell phone user operates a cell phone in a low satellite signal area, like in a car, user can utilize another active satellite antenna located outside the car to receive the satellite signal. The satellite signal is then imported into the integrated active satellite antenna module via the second input end 2 so as to obtain better antenna signal for positioning.

Figure 4:
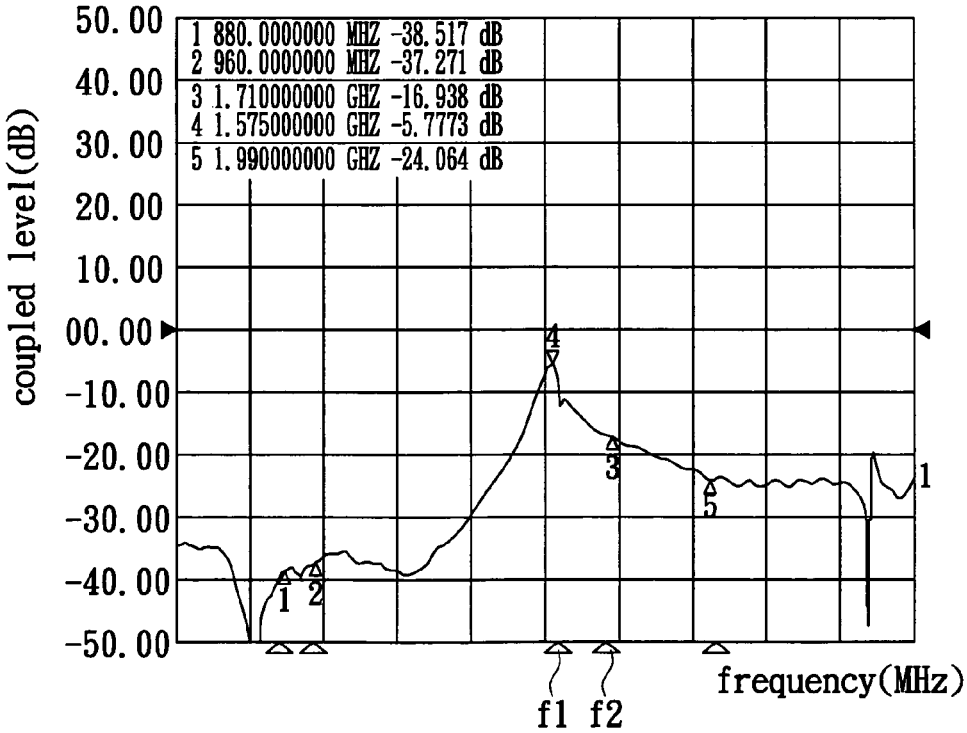
FIG. 4 is a waveform of the mutual coupled level of the GPS antenna and the GSM antenna.

Reference is made to FIG. 4, which is a waveform of the mutual coupled level of the GPS antenna and the GSM antenna. When the GPS antenna and the GSM antenna is between 5 cm, the energy of the GPS antenna has a coupled level of −5.7773 dB at a first frequency f1, and the energy of the GSM antenna has a coupled level of −16.938 dB at a second frequency f2. That is to say, the isolation is 11.1607 dB between the first frequency f1 and the second frequency f2. Hence, it is observable that there is a serious signal interference between the GPS antenna and the GSM antenna operated without using the filter.

Figure 5:
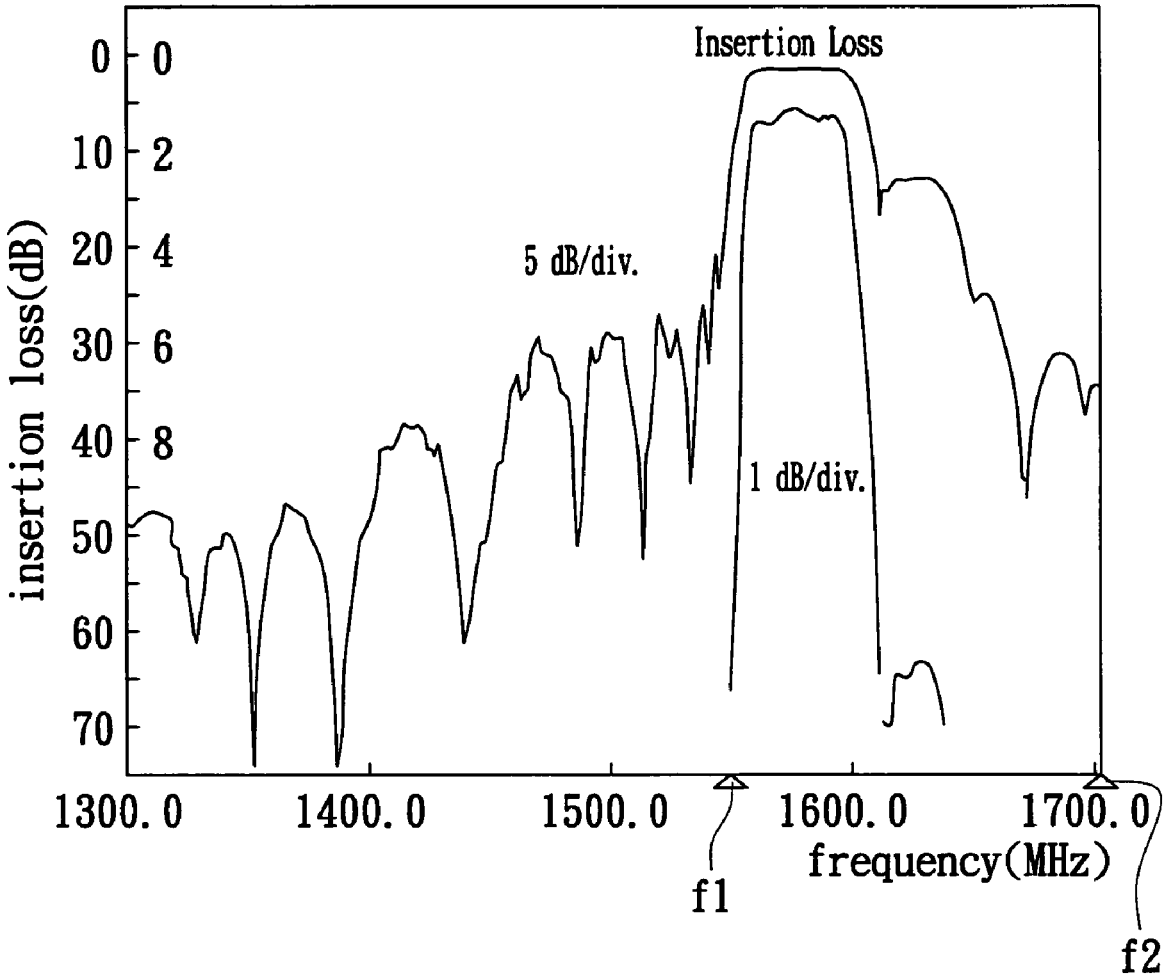
FIG. 5 is a waveform of the isolation provided from the low loss filter between 1710 MHz and 1575.42 MHz of the present invention.

Reference is made to FIG. 5, which is a waveform of the isolation provided from the low loss filter between 1710 MHz and 1575.42 MHz of the present invention. The low loss filter 3 has more than 30 dB isolation between the first frequency f1 and the second frequency f2.

Consequently, the whole system has an isolation of about 45 dB between the first frequency f1 and the second frequency f2, and the operating frequency of the second input end 2 is 1575.42 MHz.

To sum up, the present invention has at least the following advantages:

(1) An integrated active satellite antenna module provides a RF front-end circuit for resolving the mutual coupling signal interference between the satellite antenna of the integrated active satellite antenna module and other antennas operating at other frequencies.

(2) An integrated active satellite antenna module provides a RF front-end circuit for resolving a satellite signal can be demodulated to position with other antennas when a plurality of the satellite antennas is integrated in a multiple antenna module.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intend to be embraced within the scope of the invention as defined in the appended claims.

What is claimed is:

1. An integrated active satellite antenna module, comprising:

a first input end for importing a passive antenna signal thereof;

a second input end for importing an active antenna signal thereof;

a low loss filter for filtering noise and a band signal of the passive antenna signal;

a low noise amplifier for amplifying the band signal;

a switch for receiving the band signal amplified via the low noise amplifier and receiving the active antenna signal imported via the second input end for switching the antenna signal;

a chip for demodulating the antenna signal received from the switch, and a output end for exporting the antenna signal demodulated; wherein:

the first input end, the second input end, the low loss filter, the low noise amplifier, the switch, the chip, and the output end are electrically connected in order; and the electric signal has two directions:

I. The passive antenna signal imports from the first input end, and processes the low loss filter, the low noise amplifier, the switch, the chip, and the output end in order; and II. The active antenna signal imports from the second input end, and processes the switch, the chip, and the output end in order.

2. The integrated active satellite antenna module as in claim 1, wherein the active antenna signal is a global positioning system (GPS) signal.

3. The integrated active satellite antenna module as in claim 1, wherein the low loss filter is a band pass filter.

4. The integrated active satellite antenna module as in claim 1, wherein the low loss filter satisfies two conditions:

I. An insertion loss is less than about 2.0 dB; and

II. An out-band rejection at about 1710 MHz is greater than or equal to about 25 dB.

5. The integrated active satellite antenna module as in claim 1, wherein the low noise amplifier satisfies two conditions:

I. A noise figure is less than about 1.5 dB; and

II. An about 1 dB gain compression point is greater than about −25 dBm.

6. The integrated active satellite antenna module as in claim 1, wherein the chip has an RF-processing function.

7. The integrated active satellite antenna module as in claim 1, wherein the chip has a base band processing function.

8. The integrated active satellite antenna module as in claim 1, wherein the chip has an RF-processing function and also a base band processing function.

9. The integrated active satellite antenna module as in claim 1, wherein the second input end has an operating frequency of about 1575.42 MHz.

* * * * *